US011635230B2

(12) United States Patent
LeFebvre

(10) Patent No.: US 11,635,230 B2
(45) Date of Patent: Apr. 25, 2023

(54) HEATING, VENTILATION, AND AIR CONDITIONING CURB ASSEMBLY

(71) Applicant: Robert LeFebvre, Commerce City, CO (US)

(72) Inventor: Robert LeFebvre, Commerce City, CO (US)

( * ) Notice: Subject to any disclaimer, the term of this patent is extended or adjusted under 35 U.S.C. 154(b) by 234 days.

(21) Appl. No.: 17/177,769

(22) Filed: Feb. 17, 2021

(65) Prior Publication Data

US 2021/0310694 A1 Oct. 7, 2021

Related U.S. Application Data

(60) Provisional application No. 63/006,611, filed on Apr. 7, 2020.

(51) Int. Cl.

| | |
|---|---|
| ***F24F 13/32*** | (2006.01) |
| ***F24F 13/20*** | (2006.01) |
| ***F24F 3/044*** | (2006.01) |
| ***F24F 1/60*** | (2011.01) |

(52) U.S. Cl.

CPC ..... *F24F 13/32* (2013.01); *F24F 3/044* (2013.01); *F24F 13/20* (2013.01); *F24F 1/60* (2013.01); *F24F 2221/16* (2013.01)

(58) Field of Classification Search

CPC ..... F24F 13/32; F24F 1/60; F24F 2221/16

See application file for complete search history.

(56) References Cited

U.S. PATENT DOCUMENTS

| | | | | |
|---|---|---|---|---|
| 3,878,655 | A * | 4/1975 | Toth | E04B 1/98 52/27 |
| 10,578,337 | B2 * | 3/2020 | Benton | F24F 13/32 |
| 2015/0027066 | A1 * | 1/2015 | Desmond | F24F 13/081 52/27 |
| 2018/0259200 | A1 * | 9/2018 | Andersson | F24F 13/222 |

* cited by examiner

*Primary Examiner* — Lionel Nouketcha

(57) ABSTRACT

A heating, ventilation and air conditioning curb assembly includes a curb that has a planar profile for positioning on a flat roof of a building. A heating, ventilation and air conditioning unit is included that has dimensions which are unequal to dimensions of the curb. An adapter is positionable into the curb and the adapter has dimensions sufficient to accommodate dimensions of the heating, ventilation and air conditioning unit. Thus, the heating, ventilation and air conditioning unit can be installed onto the curb. A power unit is integrated into the curb to supply electrical power to the heating, ventilation and air conditioning unit in the event of a power outage thereby ensuring the heating, ventilation and air conditioning unit continues to operate. A leveling unit is coupled to the adapter for leveling the heating, ventilation and air conditioning unit.

6 Claims, 5 Drawing Sheets

HEATING, VENTILATION, AND AIR CONDITIONING CURB ASSEMBLY

(b) CROSS-REFERENCE TO RELATED APPLICATIONS

I hereby claim the benefit under 35 U.S.C. Section 119(e) of U.S. Provisional application 63/006,611 filed Apr. 7, 2020.

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to curb device and more particularly pertains to a new curb device for mounting a variety of different heating, ventilation and air conditioning units on a flat roof. The device includes a heating, ventilation and air conditioning curb and an adapter is that installable into the heating, ventilation and air conditioning curb. The adapter is structured to accommodate specific heating, ventilation and air conditioning units thereby facilitating any heating, ventilation and air conditioning unit to be installed onto the flat roof.

(2) Description of Related Art Including Information Disclosed Under 37 CFR 1.97 and 1.98

The prior art relates to curb devices including.

(h) BRIEF SUMMARY OF THE INVENTION

An embodiment of the disclosure meets the needs presented above by generally comprising a curb that has a planar profile for positioning on a flat roof of a building. A heating, ventilation and air conditioning unit is included that has dimensions which are unequal to dimensions of the curb. An adapter is positionable into the curb and the adapter has dimensions sufficient to accommodate dimensions of the heating, ventilation and air conditioning unit. Thus, the heating, ventilation and air conditioning unit can be installed onto the curb. A power unit is integrated into the curb to supply electrical power to the heating, ventilation and air conditioning unit in the event of a power outage thereby ensuring the heating, ventilation and air conditioning unit continues to operate. A leveling unit is coupled to the adapter for leveling the heating, ventilation and air conditioning unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
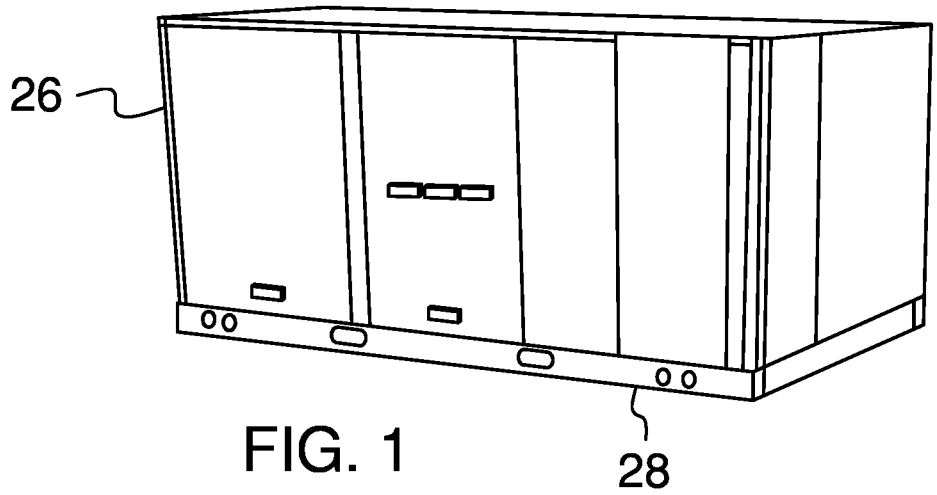
FIG. 1 is a perspective view of a heating, ventilation and air conditioning unit of a heating, ventilation and air conditioning curb assembly according to an embodiment of the disclosure.
Figure 2:
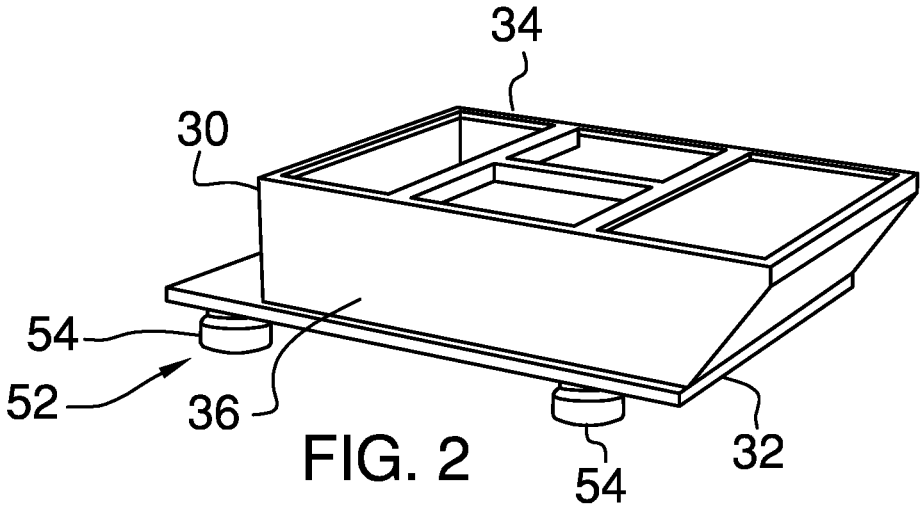
FIG. 2 is a perspective view of an adapter of an embodiment of the disclosure.
Figure 3:
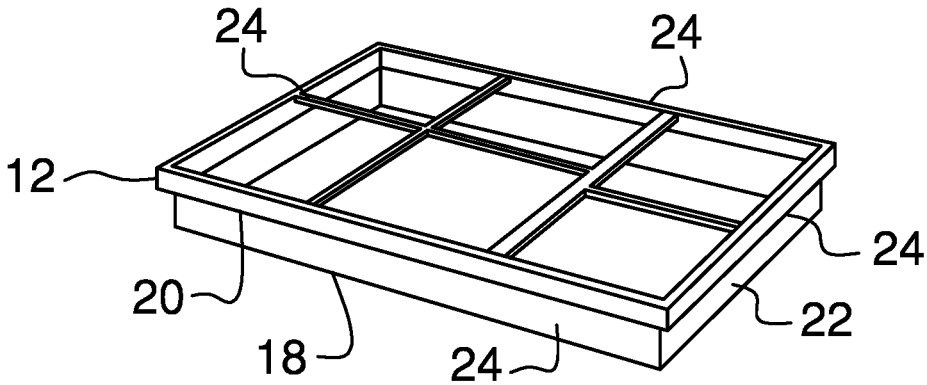
FIG. 3 is a perspective view of an embodiment of the disclosure.
Figure 4:
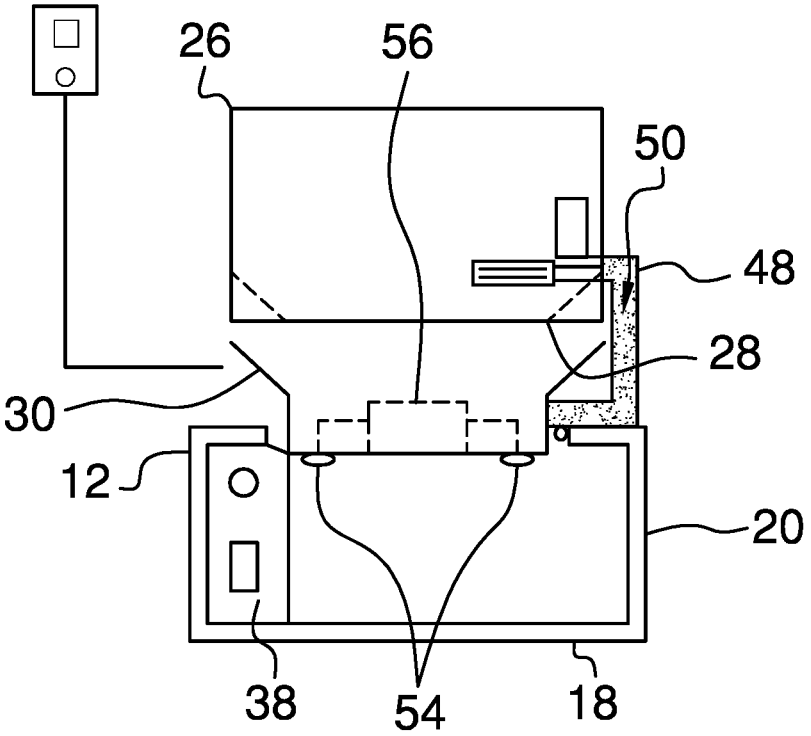
FIG. 4 is a front cut-away view of an embodiment of the disclosure.
Figure 5:
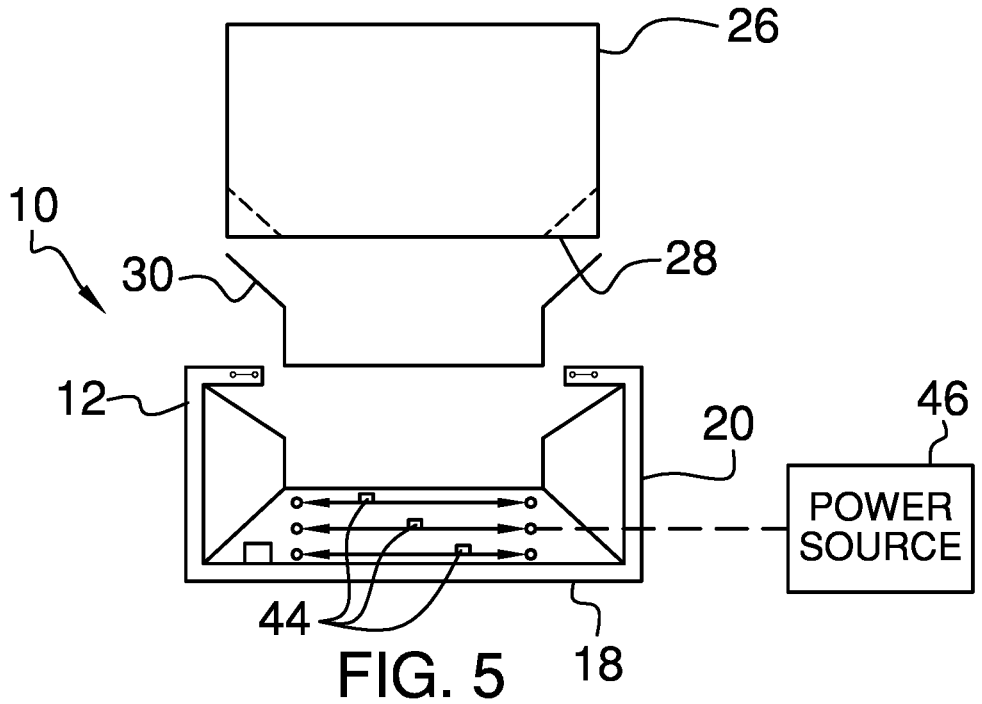
FIG. 5 is a back cut-away view of an embodiment of the disclosure.
Figure 6:
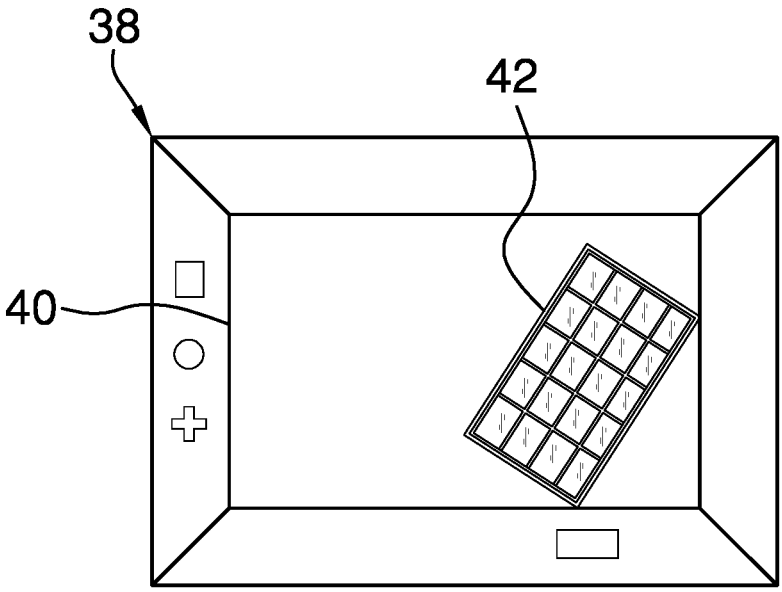
FIG. 6 is a top view of a power unit of an embodiment of the disclosure.

With reference now to the drawings, and in particular to FIGS. 1 through 8 thereof, a new curb device embodying the principles and concepts of an embodiment of the disclosure and generally designated by the reference numeral 10 will be described.

As best illustrated in FIGS. 1 through 8, the heating, ventilation and air conditioning curb assembly 10 generally comprises a curb 12 that has a planar profile such that the curb 12 can be positioned on a flat roof 14 of a building 16. The curb 12 may be a heating, ventilation and air conditioning curb of any conventional design upon which a commercial heating, ventilation and air conditioning unit can be positioned. The building 16 may be an office building, a warehouse or any other type of building that would commonly employ a roof mounted heating, ventilation and air conditioning unit. The curb 12 has a bottom wall 18 and an outer wall 20 extending upwardly from a perimeter 22 of the bottom wall 18; the bottom wall 18 rests on the flat roof 14 having the outer wall 20 extending upwardly from the flat roof 14. Additionally, the outer wall 20 has a plurality of intersecting sides 24 such that the curb 12 has a rectangular shape.

A heating, ventilation and air conditioning unit 26 is included that has dimensions which are unequal to dimensions of the curb 12, and the heating, ventilation and air conditioning unit 26 has a lower end 28. The heating, ventilation and air conditioning unit 26 may be a commercial heating, ventilation and air conditioning unit of any conventional design and may be manufactured by any existing heating, ventilation and air conditioning manufacturing company. An adapter 30 is included that has a lower end 32 which has dimensions that are less than dimensions of an upper end 34 of the adapter 30. The lower end 32 of the adapter 30 is positionable into the curb 12 and the upper end 34 has dimensions sufficient to accommodate dimensions of the heating, ventilation and air conditioning unit 26. In this way the heating, ventilation and air conditioning unit 26 can be installed onto the curb 12 thereby facilitating the heating, ventilation and air conditioning to be installed onto the flat roof 14 of the building 16. The lower end 28 of the heating, ventilation and air conditioning unit 26 is positionable on top of the upper end 34 of the adapter 30 thereby facilitating the lower end 28 of the heating, ventilation and air conditioning unit 26 to be spaced from the bottom wall 18 of the curb 12. The adapter 30 has an outer wall 36 extending between the lower end 28 and the upper end 34, and the outer wall 36 of the adapter 30 angles outwardly between the lower end 28 and the upper end 34 such that the adapter 30 approximates a trapezoid.

A power unit 38 is integrated into the curb 12 and the power unit 38 is in electrical communication with the heating, ventilation and air conditioning unit 26. In this way the power unit 38 can supply electrical power to the heating, ventilation and air conditioning unit 26 in the event of a power outage. Thus, the power unit 38 ensures the heating, ventilation and air conditioning unit 26 continues to operate during the power outage. The power unit 38 comprises at least one battery 40 that is integrated into the curb 12, and the at least one battery 40 is electrically coupled to the heating, ventilation and air conditioning unit 26. The power unit 38 includes at least one solar panel 42 that is positioned externally with respect to the curb 12 such that the at least one solar panel 42 is exposed to sunlight. Moreover, the at least one solar panel 42 is electrically coupled to the at least one battery 40 for charging the at least one battery 40.

A plurality of electrical adapters 44 is each integrated into the curb 12 and each of the electrical adapters 44 has unique features with respect to each other. Moreover, respective ones of the electrical adapters 44 are matable to power cables of the heating, ventilation and air conditioning unit 26. In this way the electrical adapters 44 facilitate universal installation of various heating, ventilation and air conditioning units on the curb 12. Each of the electrical adapters 44 is in electrical communication with a power source 46 comprising an electrical system of the building 16. In this way the plurality of electrical adapters 44 facilitates a worker to quickly connect or disconnect a variety of different heating, ventilation and air conditioning units to the electrical system of the building 16. Each of the electrical adapters 44 may be designed to be matable to existing power cables employed by respective manufacturers of heating, ventilation and air conditioning units.

A pre-cooling unit 48 is provided and the pre-cooling unit 48 is integrated into the heating, ventilation and air conditioning unit 26. The pre-cooling unit 48 is in thermal communication with the heating, ventilation and air conditioning unit 26 such that the pre-cooling unit 48 is in thermal communication with air being drawn into the heating, ventilation and air conditioning unit 26 for heat exchange. Moreover, the pre-cooling unit 48 contains a fluid condensate 50 to cool the air being drawn into the heating, ventilation and air conditioning unit 26. In this way the pre-cooling unit 48 enhances efficiency with which the heating, ventilation and air conditioning unit 26 performs air conditioning operations.

A leveling unit 52 is coupled to the adapter 30 and the leveling unit 52 engages the curb 12 when the adapter 30 is positioned in the curb 12. The leveling unit 52 adjusts an angle of the adapter 30 with respect to the curb 12 when the leveling unit 52 is actuated. In this way the leveling unit 52 can level the heating, ventilation and air conditioning unit 26 on the flat roof 14. The leveling unit 52 comprises a plurality of air bags 54 and each of the air bags 54 is coupled to the lower end 28 of the adapter 30. Each of the air bags 54 abuts the bottom wall 18 of the curb 12 when the adapter 30 is positioned in the curb 12. Moreover, each of the air bags 54 is inflatable to a selectable volume thereby facilitating the heating, ventilation and air conditioning unit 26 to be leveled on the curb 12. The leveling unit 52 includes a pump 56 that is integrated into the curb 12. The pump 56 is in fluid communication with each of the air bags 54 thereby facilitating the pump 56 to inflate or deflate all or selected ones of the air bags 54. The pump 56 may be an electric air pump that has a plurality of electronically controlled outputs to facilitate each of the air bags 54 to be independently inflated or deflated.

Figure 7:
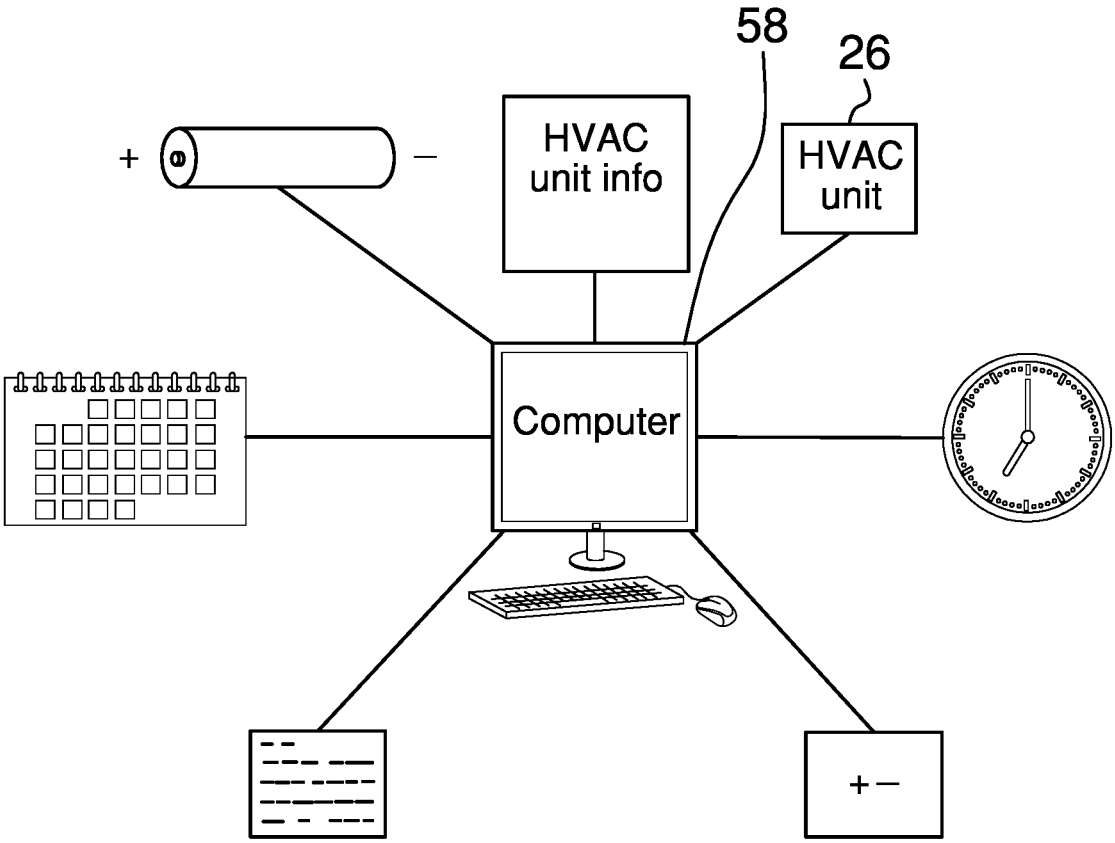
FIG. 7 is a schematic view of an embodiment of the disclosure.
Figure 8:
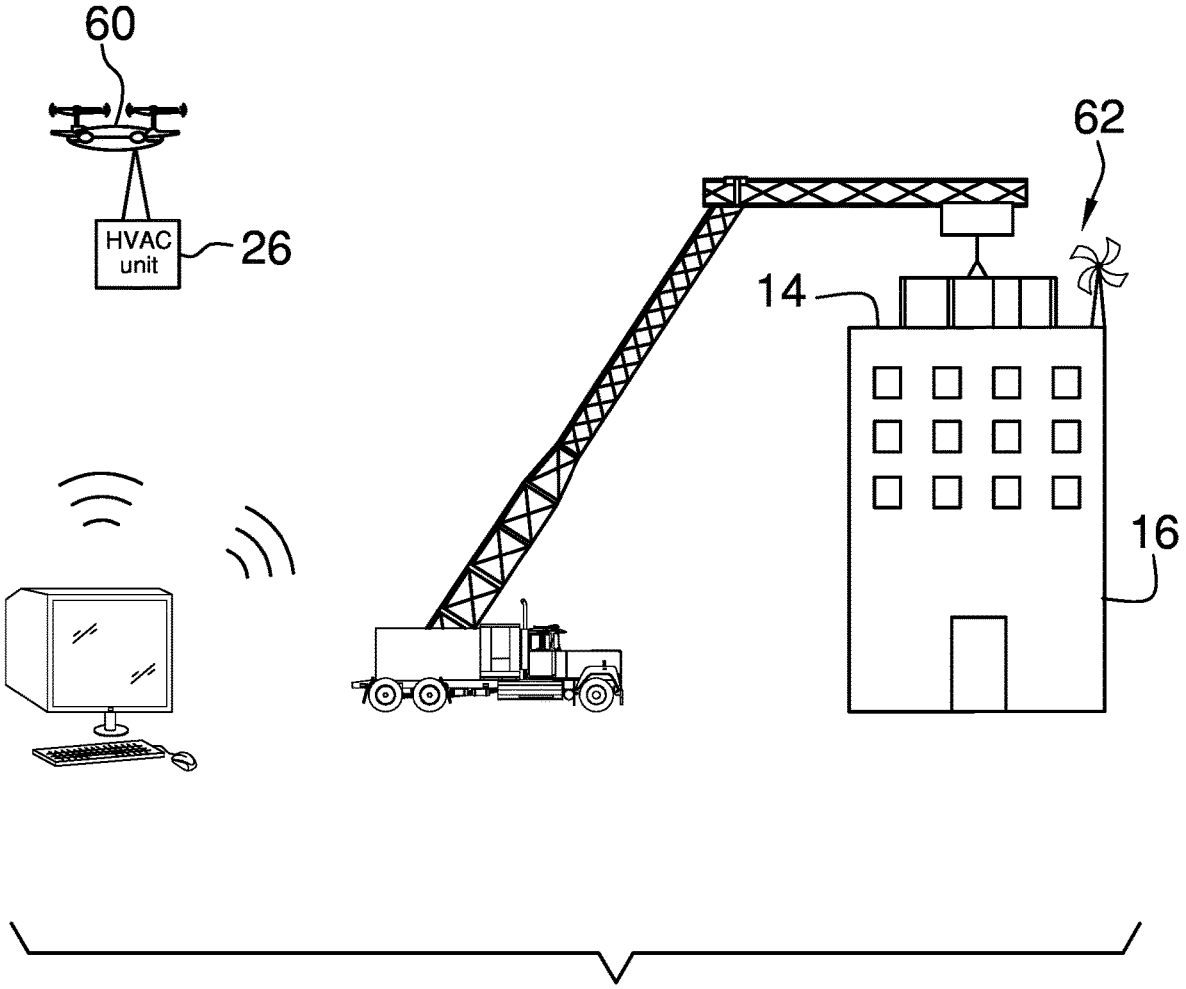
FIG. 8 is a perspective in-use view of an embodiment of the disclosure.

As is most clearly shown in FIG. 7, the heating, ventilation and air conditioning unit 26 may be in remote communication with a remote data server 58, such as a computer at a heating, ventilation and air conditioning service company. The remote data server 58 may monitor operational parameters of the heating, ventilation and air conditioning unit 26 for scheduling regular maintenance as well as scheduling service calls for operational faults the heating, ventilation and air conditioning unit 26 experiences. As is most clearly shown in FIG. 8, an unmanned aerial vehicle may 60 be provided that has a payload which is sufficient to lift the heating, ventilation and air conditioning unit 26. The unmanned aerial vehicle 60 may be in remote communication with the remote data server 58 to facilitate the heating, ventilation and air conditioning service company to control the unmanned aerial vehicle 60. In this way the heating, ventilation and air conditioning unit 26 can be removed from the flat roof 14 without the use of a crane, as is the current method of removing and replacing roof mounted heating, ventilation and air conditioning units. Moreover, the unmanned aerial vehicle 60 could facilitate the heating, ventilation and air conditioning unit 26 to be transported to a predetermined service location for repairs in a highly efficient manner compared to transporting the heating, ventilation and air conditioning unit 26 on a cargo truck. As is additionally shown in FIG. 8, an external power source 62, such as a wind turbine or other source of clean energy that is discrete from the solar panel 42, may be provided for charging the at least one battery 40 in the power unit 38.

In use, the curb 12 is installed on the flat roof 14 in the conventional manner and the adapter 30 is installed into the curb 12. The air bags 54 are inflated to appropriate volume for leveling the adapter 30 and the heating, ventilation and air conditioning unit 26 is installed onto the adapter 30. In this way a variety of different types of heating, ventilation and air conditioning units can be installed onto a single curb 12. The plurality of electrical adapters 44 facilitates the power cables of the heating, ventilation and air conditioning unit 26 to be electrically coupled to the power source 46 without the need to make permanent or semi-permanent electrical splices. In this way the process of installing the heating, ventilation and air conditioning unit 26 is simplified for service workers.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A heating, ventilation and air conditioning curb assembly to facilitate universal application of a heating, ventilation and air conditioning unit to a curb on a rooftop, said assembly comprising:

a curb having a planar profile wherein said curb is configured to be positioned on a flat roof of a building;

a heating, ventilation and air conditioning unit having dimensions being unequal to dimensions of said curb;

an adapter having a lower end which has dimensions being less than dimensions of an upper end of said adapter, said lower end being positionable into said curb, said upper end having dimensions being sufficient to accommodate dimensions of said heating, ventilation and air conditioning unit thereby facilitating said heating, ventilation and air conditioning unit to be installed onto said curb wherein said heating, ventilation and air conditioning unit is configured to be installed onto the flat roof of the building;

a power unit being integrated into said curb, said power unit being in electrical communication with said heating, ventilation and air conditioning unit such that said power unit supplies electrical power to said heating, ventilation and air conditioning unit in the event of a power outage thereby ensuring said heating, ventilation and air conditioning unit continues to operate; and a leveling unit being coupled to said adapter, said leveling unit engaging said curb when said adapter is positioned in said curb, said leveling unit adjusting an angle of said adapter with respect to said curb wherein said leveling unit is configured to level the heating, ventilation and air conditioning unit.

2. The assembly according to claim 1, wherein:

said curb has a bottom wall and an outer wall extending upwardly from a perimeter of said bottom wall wherein said bottom wall is configured to rest on the flat roof having said outer wall extending upwardly from the flat roof, said outer wall having a plurality of intersecting sides such that said curb has a rectangular shape; and said heating, ventilation and air conditioning unit has a lower end, said lower end of said heating, ventilation and air conditioning unit being positionable on top of said upper end of said adapter thereby facilitating said heating, ventilation and air conditioning unit to be spaced from said bottom wall of said curb.

3. The assembly according to claim 1, further comprising a plurality of electrical adapters, each of said electrical adapters being integrated into said curb, each of said electrical adapters having unique features with respect to each other, respective ones of said electrical adapters being matable to power cables of said heating, ventilation and air conditioning unit thereby facilitating universal installation of various heating, ventilation and air conditioning units on said curb, each of said electrical adapters being in electrical communication with a power source comprising an electrical system of the building wherein said plurality of electrical adapters is configured to facilitate a worker to quickly connect or disconnect a variety of different heating, ventilation and air conditioning units to the electrical system of the building.

4. The assembly according to claim 1, further comprising a pre-cooling unit being integrated into said heating, ventilation and air conditioning unit, said pre-cooling unit being in thermal communication with said heating, ventilation and air conditioning unit wherein said pre-cooling unit is configured to be in thermal communication with air being drawn into said heating, ventilation and air conditioning unit for heat exchange, said pre-cooling unit containing a fluid condensate wherein said pre-cooling unit is configured to cool the air being drawn into said heating, ventilation and air conditioning unit thereby enhancing efficiency with which said heating, ventilation and air conditioning unit performs air conditioning operations.

5. The assembly according to claim 2, wherein said leveling unit comprises:

a plurality of air bags, each of said air bags being coupled to said lower end of said adapter, each of said air bags abutting said bottom wall of said curb when said adapter is positioned in said curb, each of said air bags being inflatable to a selectable volume thereby facilitating said heating, ventilation and air conditioning unit to be leveled on said curb; and a pump being integrated into said curb, said pump being in fluid communication with each of said air bags thereby facilitating said pump to inflate or deflate all or selected ones of said air bags.

6. A heating, ventilation and air conditioning curb assembly to facilitate universal application of a heating, ventilation and air conditioning unit to a curb on a rooftop, said assembly comprising:

a curb having a planar profile wherein said curb is configured to be positioned on a flat roof of a building, said curb having a bottom wall and an outer wall extending upwardly from a perimeter of said bottom wall wherein said bottom wall is configured to rest on the flat roof having said outer wall extending upwardly from the flat roof, said outer wall having a plurality of intersecting sides such that said curb has a rectangular shape;

an heating, ventilation and air conditioning unit having dimensions being unequal to dimensions of said curb, said heating, ventilation and air conditioning unit having a lower end;

an adapter having a lower end having dimensions being less than dimensions of an upper end of said adapter, said lower end being positionable into said curb, said upper end having dimensions being sufficient to accommodate dimensions of said heating, ventilation and air conditioning unit thereby facilitating said heating, ventilation and air conditioning unit to be installed onto said curb wherein said heating, ventilation and air conditioning unit is configured to be installed onto the flat roof of the building, said lower end of said heating, ventilation and air conditioning unit being positionable on top of said upper end of said adapter thereby facilitating said heating, ventilation and air conditioning unit to be spaced from said bottom wall of said curb, said adapter having an outer wall extending between said lower end and said upper end, said outer wall angling outwardly between said lower end and said upper end such that said adapter approximates a trapezoid;

a power unit being integrated into said curb, said power unit being in electrical communication with said heating, ventilation and air conditioning unit such that said power unit supplies electrical power to said heating, ventilation and air conditioning unit in the event of a power outage thereby ensuring said heating, ventilation and air conditioning unit continues to operate, said power unit comprising:

at least one battery being integrated into said curb, said at least one battery being electrically coupled to said heating, ventilation and air conditioning unit; and at least one solar panel being positioned externally with respect to said curb wherein said at least one solar panel is configured to be exposed to sunlight, said at least one solar panel being electrically coupled to said at least one battery for charging said at least one battery;

a plurality of electrical adapters, each of said electrical adapters being integrated into said curb, each of said electrical adapters having unique features with respect to each other, respective ones of said electrical adapters being matable to power cables of said heating, ventilation and air conditioning unit thereby facilitating universal installation of various heating, ventilation and air conditioning units on said curb, each of said electrical adapters being in electrical communication with a power source comprising an electrical system of the building wherein said plurality of electrical adapters is configured to facilitate a worker to quickly connect or disconnect a variety of different heating, ventilation and air conditioning units to the electrical system of the building;

a pre-cooling unit being integrated into said heating, ventilation and air conditioning unit, said pre-cooling unit being in thermal communication with said heating, ventilation and air conditioning unit wherein said pre-cooling unit is configured to be in thermal communication with air being drawn into said heating, ventilation and air conditioning unit for heat exchange, said pre-cooling unit containing a fluid condensate wherein said pre-cooling unit is configured to cool the air being drawn into said heating, ventilation and air conditioning unit thereby enhancing efficiency with which said heating, ventilation and air conditioning unit performs air conditioning operations; and a leveling unit being coupled to said adapter, said leveling unit engaging said curb when said adapter is positioned in said curb, said leveling unit adjusting an angle of said adapter with respect to said curb wherein said leveling unit is configured to level the heating, ventilation and air conditioning unit, said leveling unit comprising:

a plurality of air bags, each of said air bags being coupled to said lower end of said adapter, each of said air bags abutting said bottom wall of said curb when said adapter is positioned in said curb, each of said air bags being inflatable to a selectable volume thereby facilitating said heating, ventilation and air conditioning unit to be leveled on said curb; and a pump being integrated into said curb, said pump being in fluid communication with each of said air bags thereby facilitating said pump to inflate or deflate all or selected ones of said air bags.

* * * * *